US007287753B1

(12) United States Patent
Brigidi

(10) Patent No.: US 7,287,753 B1
(45) Date of Patent: Oct. 30, 2007

(54) GAME AND METHOD OF PLAY

(76) Inventor: Frank J. Brigidi, 10111 Centennial Rd., Warminster, PA (US) 18974

( * ) Notice: Subject to any disclaimer, the term of this patent is extended or adjusted under 35 U.S.C. 154(b) by 76 days.

(21) Appl. No.: 11/191,364

(22) Filed: Jul. 28, 2005

Related U.S. Application Data

(60) Provisional application No. 60/598,089, filed on Aug. 2, 2004.

(51) Int. Cl.
*A63F 3/00* (2006.01)

(52) U.S. Cl. ..... 273/256; 273/278

(58) Field of Classification Search ..... 273/256, 273/278

See application file for complete search history.

(56) References Cited

U.S. PATENT DOCUMENTS 2,026,082 A * 12/1935 Darrow ..... 273/256
4,136,881 A * 1/1979 Anspach ..... 273/256
4,397,467 A * 8/1983 Thornton ..... 273/256
4,902,020 A * 2/1990 Auxier ..... 273/256
6,164,650 A * 12/2000 Wilkins et al. ..... 273/256
6,764,077 B1 * 7/2004 Miravete ..... 273/256

* cited by examiner

*Primary Examiner*—Vishu K. Mendiratta
(74) *Attorney, Agent, or Firm*—Ted Masters

(57) ABSTRACT

A game for a plurality of players includes a playing area having playing stations which form a path along which the players move game pieces. The playing area includes a plurality of franchise site playing stations which represent a franchise location, such as a city. The players each pick a business entity such as a particular fast food chain. The object of the game is for a player to establish a franchise for his/her chosen business entity at each franchise site playing station.

21 Claims, 8 Drawing Sheets

FIG. 10

44

VIOLATION!
YOU (FRANCHISEE) ARE IN VIOLATION.
OF STANDARD OPERATING PROCEDURES.
MOVE BACK TO THE LAST PLAYING
STATION ON THE BOARD.
PAY FRANCHISE FEE
PAY $500

FIG. 11

48

COMMUNITY - INVOLVEMENT
BUSINESS LUNCH!
THE LOCAL CHAMBER OF COMMERCE
ORDERS A WEEKLY LUNCH FOR $25
COLLECT $1000

FIG. 12

58

HOW SMART!
SPONSORS AWARD YOUR FRANCHISE
SITE A SCHOLARSHIP GRANT FOR
TRAINING STUDENTS
COLLECT $5,000

FIG. 13

64

AREA DIRECTOR
DIRECTORSHIP
TERRITORY

#1 #2 #3 #4

FIG. 14

64

EACH TIME A
FRANCHISEE PASSES
WEEKLY SALARY

COLLECT SALARY
COMMISSION OF
$2,000 FOR ALL SITES
LEFT IN BANK AS
THEY ARE SOLD

66

#1 #2 #3 #4

OPTION TO BUY

NEW YORK, NY
PROPERTY

66

OPTION TO BUY

PAY BANK $1000
FOR OPTION
IF NOT TAKEN

FRANCHISEE LOSES
DEPOSIT

68

70

#2

SITE & EQUIPMENT
TURN-KEY-OPERATION
OWNER-OPERATOR

TOTAL VALUE
$30,000
DALLAS, TX

70

ACQUISITION

DOWN PAYMENT... $6,000
SITE BALANCE.....$24,000

PRODUCT/SERVICE FEE
$ 600
DUE PER EACH
DOWN PAYMENT

72

C

CHALLENGE

FIG. 21

74

CHICAGO, IL

VALUE $20,000

| | |
|---|---|
| ☐ DOWN PAYMENT | $4,000 |
| ☐ MORTGAGE PAYMENT #1 | $4,000 |
| ☐ MORTGAGE PAYMENT #2 | $4,000 |
| ☐ MORTGAGE PAYMENT #3 | $4,000 |
| ☐ MORTGAGE PAYMENT #4 | $4,000 |

NEW YORK, NY

VALUE $25,000

| | |
|---|---|
| ☐ DOWN PAYMENT | $5,000 |
| ☐ MORTGAGE PAYMENT #1 | $5,000 |
| ☐ MORTGAGE PAYMENT #2 | $5,000 |
| ☐ MORTGAGE PAYMENT #3 | $5,000 |
| ☐ MORTGAGE PAYMENT #4 | $5,000 |

DALLAS, TX

VALUE $30,000

| | |
|---|---|
| ☐ DOWN PAYMENT | $6,000 |
| ☐ MORTGAGE PAYMENT #1 | $6,000 |
| ☐ MORTGAGE PAYMENT #2 | $6,000 |
| ☐ MORTGAGE PAYMENT #3 | $6,000 |
| ☐ MORTGAGE PAYMENT #4 | $6,000 |

PHILADELPHIA, PA

VALUE $15,000

| | |
|---|---|
| ☐ DOWN PAYMENT | $3,000 |
| ☐ MORTGAGE PAYMENT #1 | $3,000 |
| ☐ MORTGAGE PAYMENT #2 | $3,000 |
| ☐ MORTGAGE PAYMENT #3 | $3,000 |
| ☐ MORTGAGE PAYMENT #4 | $3,000 |

DENVER, CO

VALUE $20,000

| | |
|---|---|
| ☐ DOWN PAYMENT | $4,000 |
| ☐ MORTGAGE PAYMENT #1 | $4,000 |
| ☐ MORTGAGE PAYMENT #2 | $4,000 |
| ☐ MORTGAGE PAYMENT #3 | $4,000 |
| ☐ MORTGAGE PAYMENT #4 | $4,000 |

RENO, NV

VALUE $30,000

| | |
|---|---|
| ☐ DOWN PAYMENT | $6,000 |
| ☐ MORTGAGE PAYMENT #1 | $6,000 |
| ☐ MORTGAGE PAYMENT #2 | $6,000 |
| ☐ MORTGAGE PAYMENT #3 | $6,000 |
| ☐ MORTGAGE PAYMENT #4 | $6,000 |

LOS ANGELES, CA

VALUE $40,000

| | |
|---|---|
| ☐ DOWN PAYMENT | $8,000 |
| ☐ MORTGAGE PAYMENT #1 | $8,000 |
| ☐ MORTGAGE PAYMENT #2 | $8,000 |
| ☐ MORTGAGE PAYMENT #3 | $8,000 |
| ☐ MORTGAGE PAYMENT #4 | $8,000 |

TORONTO, ONT

VALUE $20,000

| | |
|---|---|
| ☐ DOWN PAYMENT | $4,000 |
| ☐ MORTGAGE PAYMENT #1 | $4,000 |
| ☐ MORTGAGE PAYMENT #2 | $4,000 |
| ☐ MORTGAGE PAYMENT #3 | $4,000 |
| ☐ MORTGAGE PAYMENT #4 | $4,000 |

NASHVILLE, TN

VALUE $15,000

| | |
|---|---|
| ☐ DOWN PAYMENT | $3,000 |
| ☐ MORTGAGE PAYMENT #1 | $3,000 |
| ☐ MORTGAGE PAYMENT #2 | $3,000 |
| ☐ MORTGAGE PAYMENT #3 | $3,000 |
| ☐ MORTGAGE PAYMENT #4 | $3,000 |

TAMPA, FL

VALUE $35,000

| | |
|---|---|
| ☐ DOWN PAYMENT | $7,000 |
| ☐ MORTGAGE PAYMENT #1 | $7,000 |
| ☐ MORTGAGE PAYMENT #2 | $7,000 |
| ☐ MORTGAGE PAYMENT #3 | $7,000 |
| ☐ MORTGAGE PAYMENT #4 | $7,000 |

GAME AND METHOD OF PLAY

CROSS REFERENCE TO RELATED APPLICATION

This application claims the filing benefit under 35 U.S.C. §119(e) of U.S. Provisional Application No. 60/598,089, filed Aug. 2, 2004, which is included herein by reference.

TECHNICAL FIELD

The present invention pertains generally to games, and more particularly to a board game in which players roll dice and move game pieces around a game board.

BACKGROUND OF THE INVENTION

Board games are well known in the art. These games generally comprise a square game board having a playing surface upon which a plurality of playing stations are disposed. Players take turns rolling dice and moving their game pieces around the playing stations of the game board. In certain of these games, when a player's game piece lands upon a particular playing station the rules pertaining to that playing station are imposed.

BRIEF SUMMARY OF THE INVENTION

The present invention is directed to a board game and method of play. A preferred name for the game is "MIND YOUR OWN BUSINESS". The game is fun, rewarding, educational, challenging, and provides the player with the excitement of experiencing the risks and rewards of buying and selling franchises and learning about the pitfalls and profits along the way. The game teaches the players how to maneuver through the ups and downs of business cycles and have fin while learning.

Players roll dice and travel around the perimeter of the game board learning the risks and rewards of the world of business and franchising. In an embodiment of the game, each player initially selects a business entity (a franchise sponsor). For example player one might select Sponsor #4 (a fast food chain), player two Sponsor #1 (a office supply chain), player three Sponsor #3 (a restaurant chain), and player four Sponsor #2 (an auto parts chain). The object of the game is for a player to establish his/her selected franchise in all ten franchise sites (cities) which are disposed around the perimeter of the game board. The first player to have his/her franchises in all ten franchise sites wins the game. In an alternative embodiment of the game, the players set a playing time limit. The player who has established the most franchises at the end of the time period wins the game.

In accordance with a preferred embodiment of the invention, a game for a plurality of players includes a playing area. A plurality of playing stations are disposed upon the playing area, the plurality of playing stations forming a path along which the game pieces (tokens, symbols, markers, etc.) of the players may move. A randomizer, such as dice, is used to determine the extent of movement of the game pieces along the path. The plurality of playing stations includes a plurality of franchise site playing stations, wherein each franchise site playing station represents a unique franchise site, such as a city. Each player chooses a business entity or sponsor, such as a fast food chain, restaurant chain, auto parts chain etc., which he/she represents. The object of the game is for a player to establish a franchise for his/her business entity at each franchise site playing station. When a franchise is established, the player places a business entity marker representing his/her business entity on the franchise site playing station.

In accordance with an aspect of the invention, the playing stations include playing stations having indicia which indicate a specific business expense which the player must pay when the player's game piece lands upon that playing station.

In accordance with another aspect of the invention, the plurality of playing stations includes playing stations having indicia which effects a randomly determined business expense. When a player's game piece lands upon one of these playing stations, the player draws a business expense card from a deck of business expense cards to determine the business expense.

In accordance with another aspect of the invention, the plurality of playing stations includes playing stations having indicia which effects a randomly determined business opportunity. When a player's game piece lands upon one of these playing stations, the player draws a business opportunity card from a deck of business opportunity cards to determine the business opportunity.

In accordance with another aspect of the invention, the plurality of playing stations includes playing stations having indicia which represents a franchise headquarters for one of the business entities. When a player's game piece lands upon the franchise headquarters for his/her business entity, the player may purchase any unowned franchise site.

In accordance with another aspect of the invention, the plurality of playing stations includes playing stations having indicia which indicates a bank dividend. When a player's game piece lands upon one of these playing stations, the player is paid a bank dividend.

In accordance with another aspect of the invention, the plurality of playing stations includes playing stations having indicia which effects a randomly determined business bonus. When a player's game piece lands upon one of these playing stations, the player draws a bonus card from a deck of bonus cards to determine the bonus.

In accordance with another aspect of the invention, the plurality of playing stations includes playing stations having indicia which randomly allows a player to acquire a franchise site from another player.

In accordance with another aspect of the invention, an ultimate franchise challenge playing station is disposed upon the playing area, the ultimate franchise challenge playing station not being part of the path. The ultimate franchise challenge playing station has indicia which randomly allows a player to acquire franchise sites from all other players.

In accordance with another aspect of the invention, the plurality of playing stations includes playing stations having indicia which represents a business entity. The indicia is typically the logo of the business entity, and may be placed on desired playing stations.

In accordance with another aspect of the invention, the randomizer includes two conventional dice plus a third die having a representation of a number one on one side and five blank sides. In an embodiment of the game, the representation of the number one is a red dot.

Other aspects of the present invention will become apparent from the following detailed description, taken in conjunction with the accompanying drawings, which illustrate, by way of example, the principles of the invention.

BRIEF DESCRIPTION OF THE DRAWINGS

FIG. 10 is a top plan view of a business expense card;

FIG. 11 is a top plan view of a business opportunity card;

FIG. 12 is a top plan view of a bonus card;

FIG. 13 is a top plan view of an area director card;

FIG. 14 is a bottom plan view of the area director card;

FIG. 21 is a top plan view of a mortgage payment sheet.

DETAILED DESCRIPTION OF THE INVENTION

Figure 1:
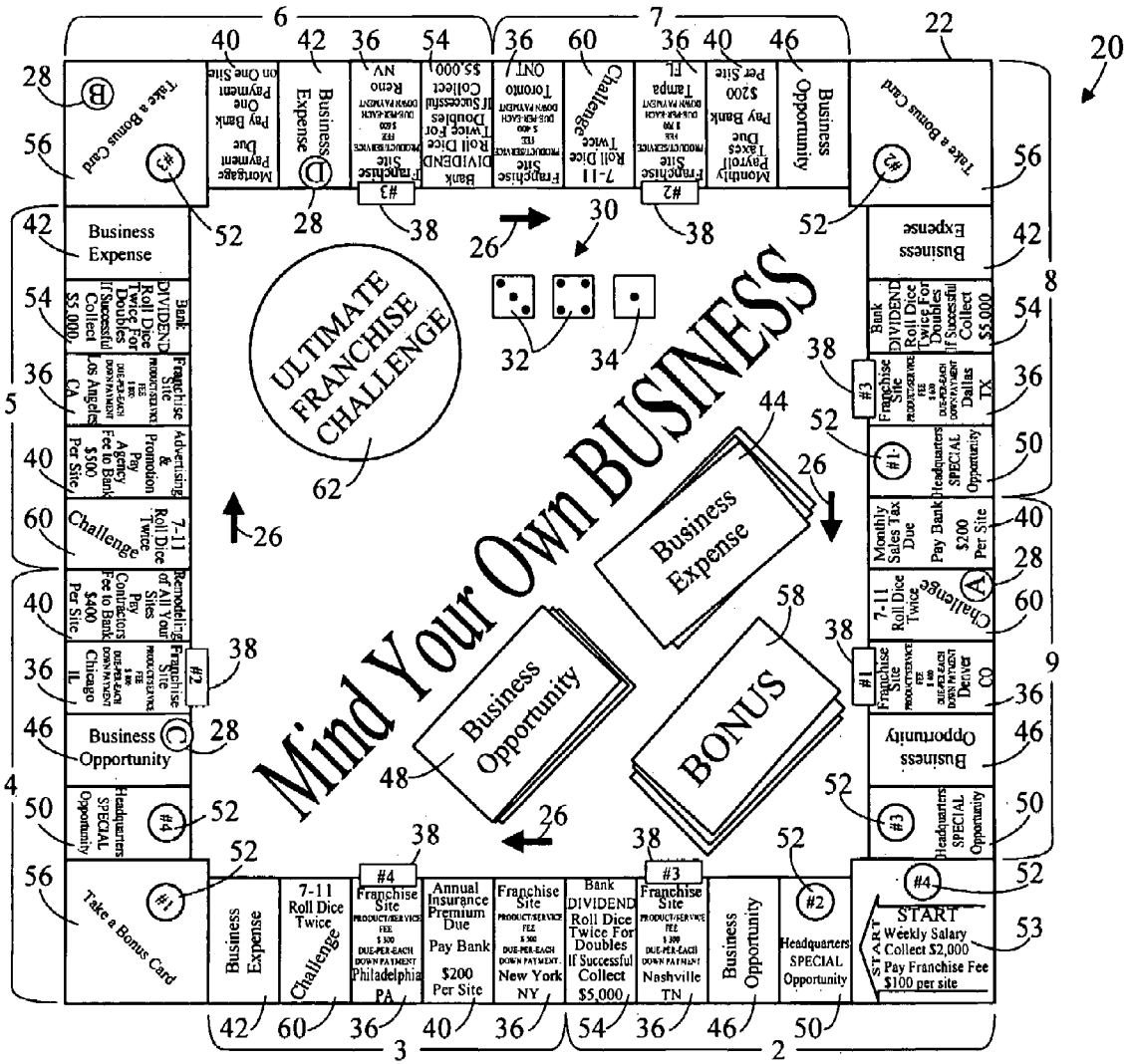
FIG. 1 is top plan view of the playing area of the game of the present invention.
Figure 2:
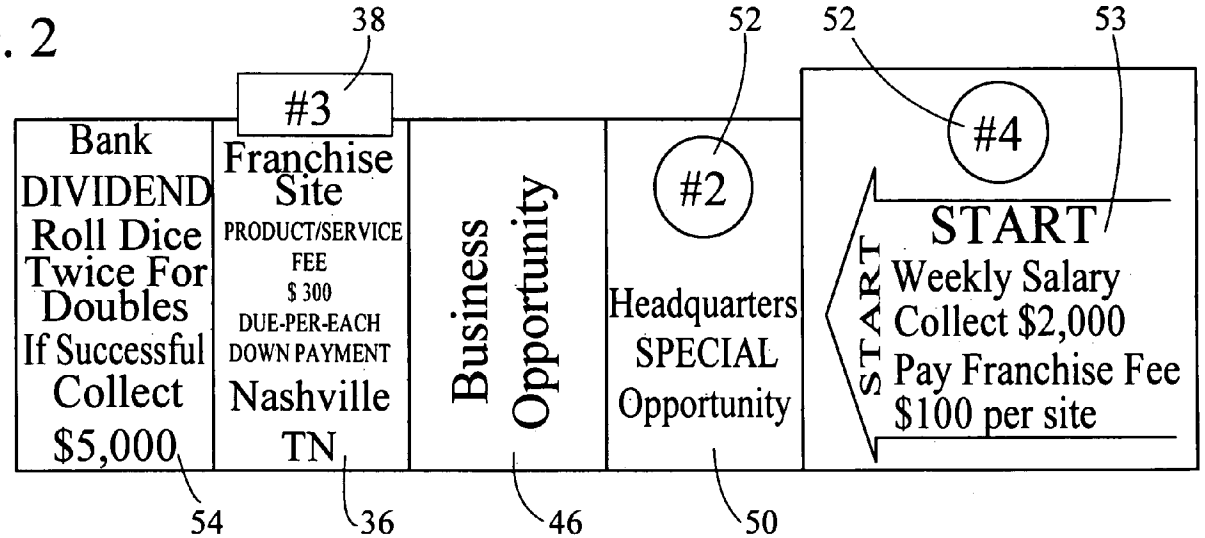
FIG. 2 is an enlarged view of area 2 of FIG. 1.
Figure 3:
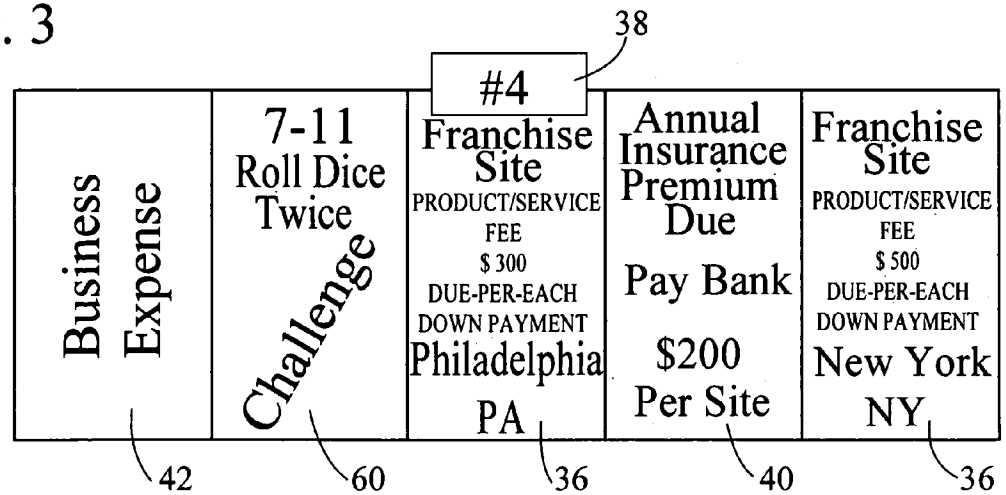
FIG. 3 is an enlarged view of area 3 of FIG. 1.
Figure 4:
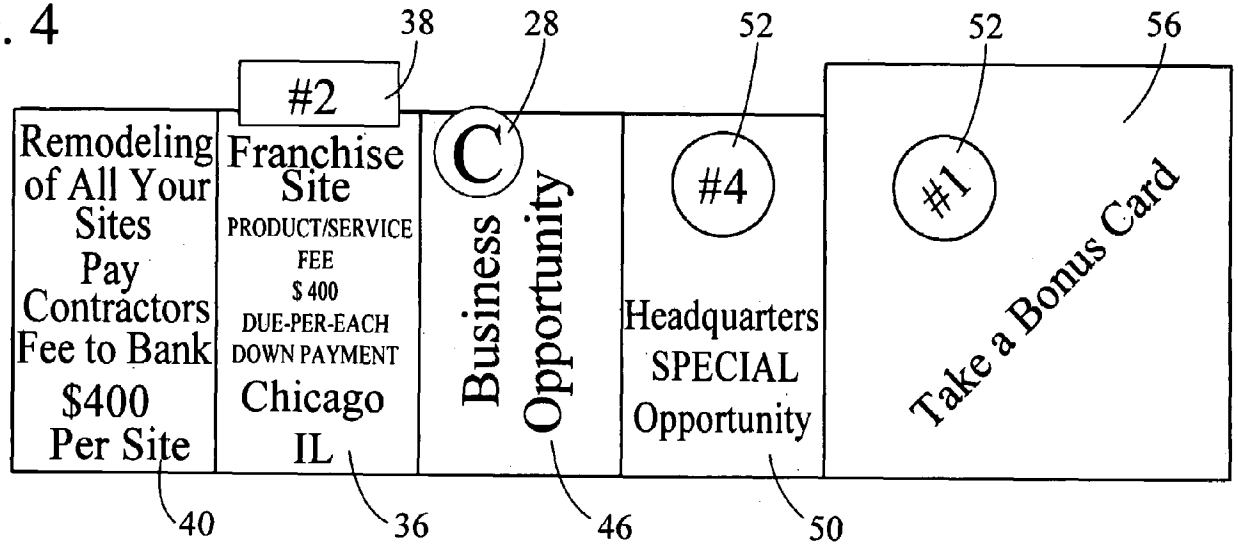
FIG. 4 is an enlarged view of area 4 of FIG. 1.
Figure 5:
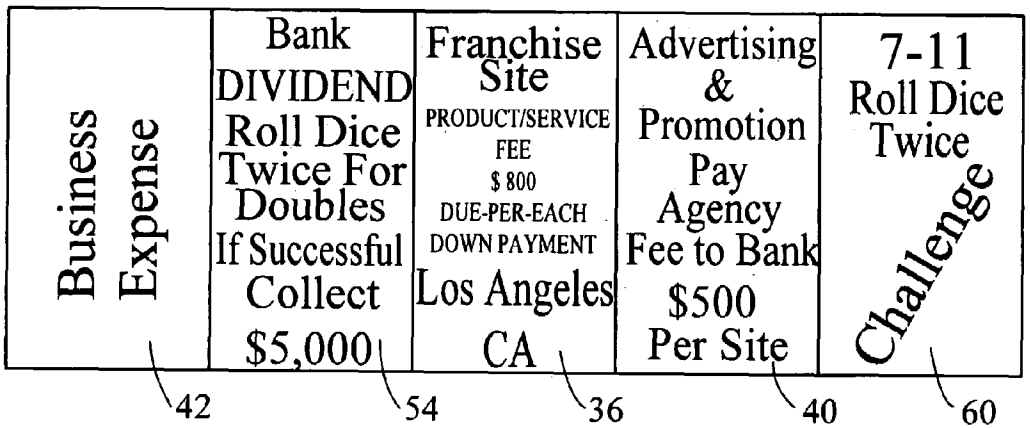
FIG. 5 is an enlarged view of area 5 of FIG. 1.
Figure 6:
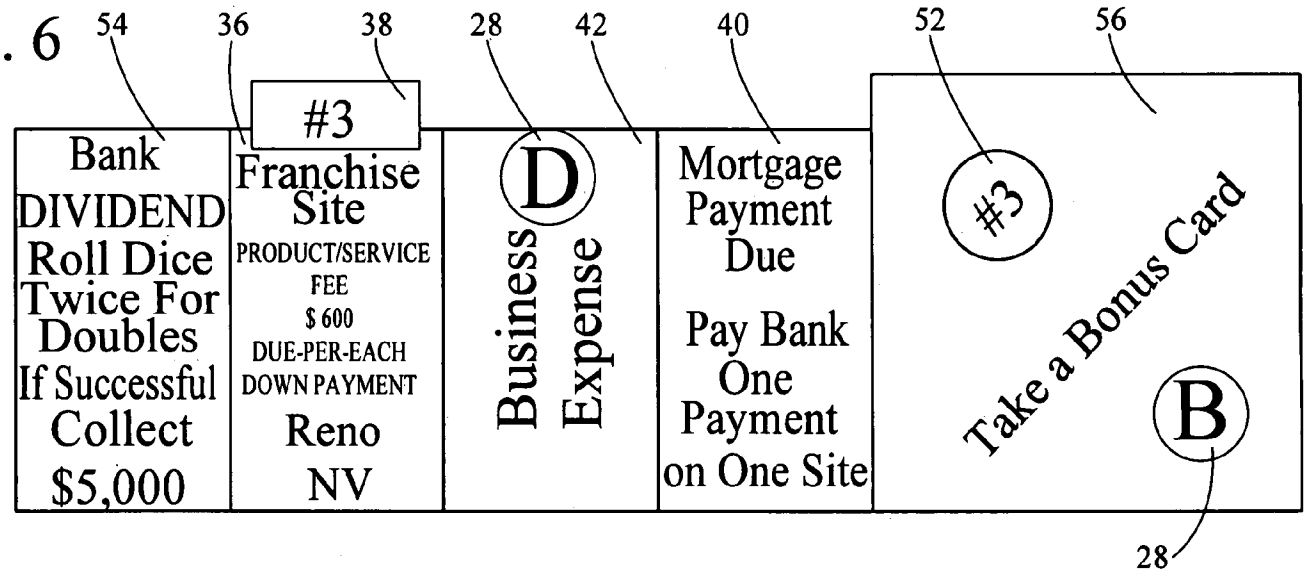
FIG. 6 is an enlarged view of area 6 of FIG. 1.
Figure 7:
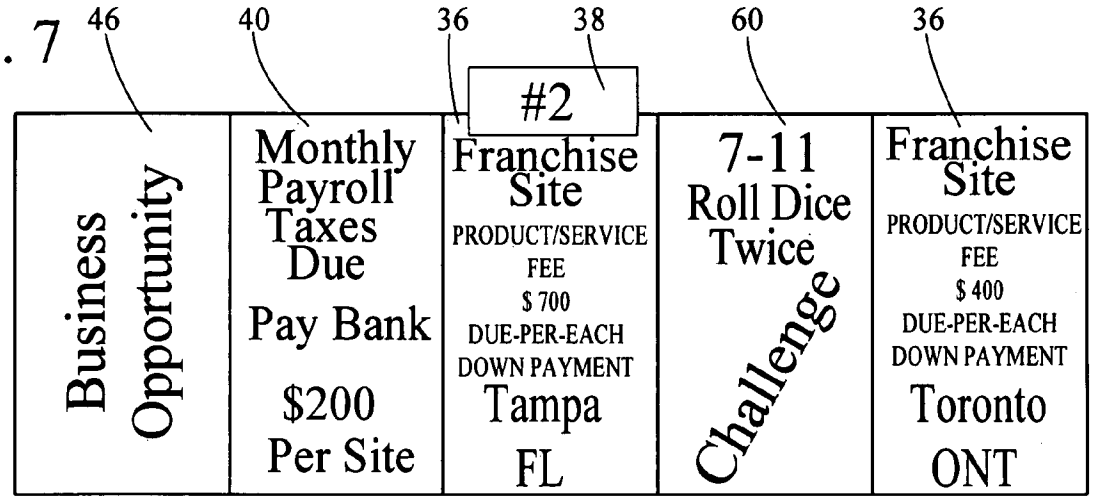
FIG. 7 is an enlarged view of area 7 of FIG. 1.
Figure 8:
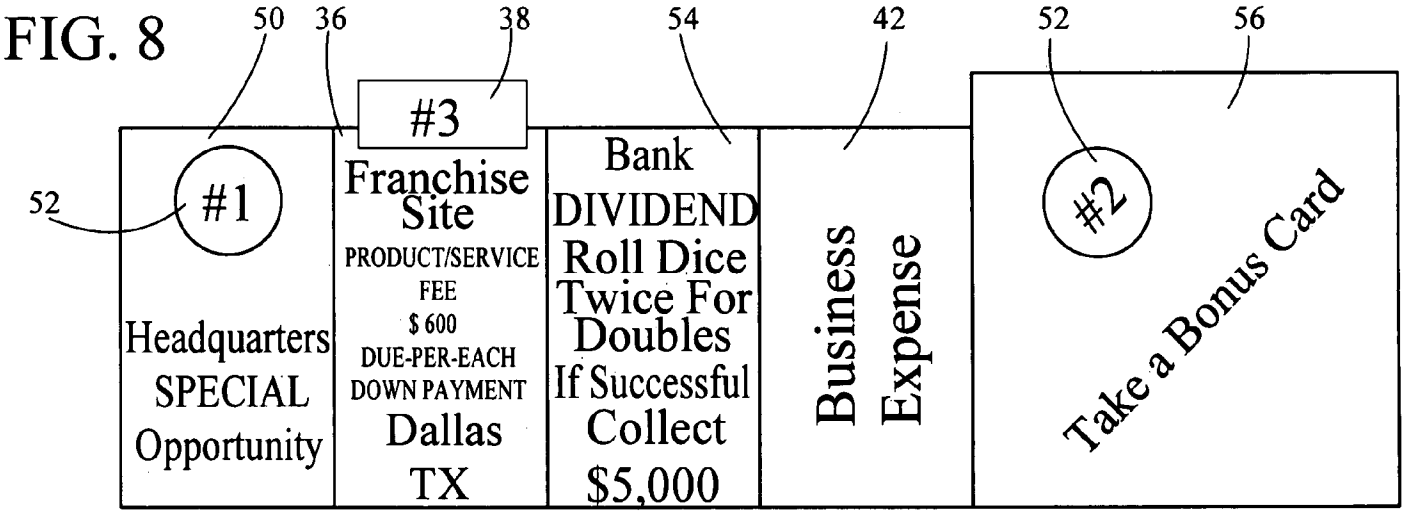
FIG. 8 is an enlarged view of area 8 of FIG. 1.
Figure 9:
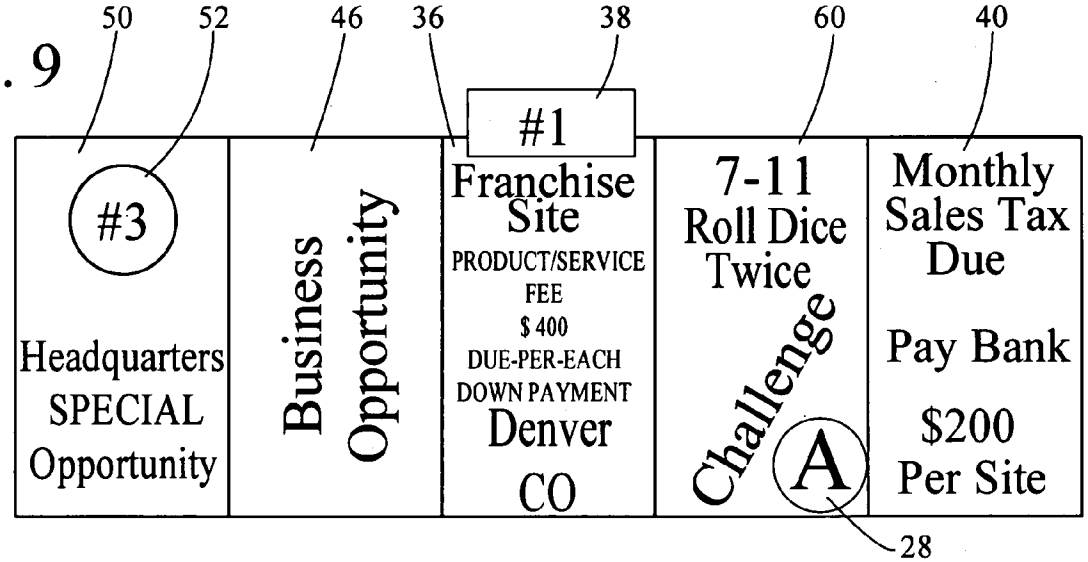
FIG. 9 is an enlarged view of area 9 of FIG. 1.

Referring initially to FIG. 1 (and also to enlarged FIGS. 2-9), there is illustrated a top plan view of the playing area of the game of the present invention, the playing area generally designated as 20. In the shown embodiment playing area 20 is a square game board 22. A plurality of playing stations are disposed upon playing area 20 around the perimeter of game board 22, the plurality of playing stations forming a continuous closed path 26 along which game pieces 28 for each of the plurality of players may move (game pieces A, B, C, and D for four players). In the shown embodiment, 40 playing stations are utilized, 11 on each side of the board, with the four corner stations been shared by adjacent sides.

While the shown embodiment utilizes a four sided game board 22, it may be appreciated that playing area 20 could also be disposed upon a gaming table, a playing cloth, a video game, a playstation, a bar top game, a slot machine, a TV set, a computer monitor, a portable hand held game, or any other useful playing surface. Accordingly, the various terms employed in the description to identify physical components, such as "a playing area" and "game pieces" should be taken to include electronic media equivalents. Additionally, the game of the present invention could be played between geographically remote players over the Internet.

A randomizer 30 is used to determine the extent of movement of game pieces 28 along path 26. In the shown embodiment, randomizer 30 includes two conventional dice 32 plus a third die 34 which has a representation of a number one on one side and five blank sides. When it is a player's turn, the player rolls the three dice. The total of the two conventional dice 32 dictate how many playing stations the player moves along path 26. That is, third die 34 does not count in the determination of the extent of movement of game pieces 28 along path 26. Also, as will be seen later, randomizer 30 is also used for other game activities. While three dice are used in the shown embodiment, it may be appreciated that other randomizers 30 such as a spinning wheel(s), a random number generator, cards, or the like, could also be used to determine the number of playing stations that a game piece 28 is moved along path 26 during a player's turn, or for other game purposes.

The plurality of playing stations include a plurality of franchise site playing stations 36 (also referred to herein as a franchise site or simply site), each franchise site playing station 36 has indicia which represents a unique franchise site 36. In the shown embodiment, there are 10 franchise sites 36, each franchise site 36 being a city in which a player can establish a franchise. It may be appreciated however, that franchise sites 36 could be other locations such as different areas within the same city. Establishing a franchise means that the owner of the franchise site 36 (one of the players), has the right to sell his/her products or services for a specific period at that specific location. The period lasts for as long as the player owns the franchise for the franchise site 36. In game terminology, when a player establishes a franchise on a franchise site playing station 36, the player "owns" the franchise site playing station 36.

The game of the present invention further includes a plurality of business entities (sponsors). In the shown embodiment of the invention, there are four different business entities (represented by logos #1, #2, #3, and #4). The business entities can be a fast food company, a office supply company, a restaurant, an auto parts company, or any other organization which establishes outlets for goods and/or services at multiple geographic locations. There are a plurality of business entity markers 38 which represent the business entities. At the start of the game, by selection, each player becomes associated with one of the business entities. For example, one player might be the fast food company, one player the office supply company, one player a restaurant chain, and one player an auto parts company.

The object of the game is for a player to establish a franchise for his/her business entity at each franchise site playing station 36. When a franchise is established, the player places a business entity marker 38 for his/her business entity upon (meaning on or adjacent to) the established franchise site playing station 36. It is noted that once a franchise is established by one player on a particular franchise site playing station 36, other players are prevented from establishing a franchise on that same franchise site playing station 36 unless rules of the game, to be discussed later, specifically so permit.

In the course of play, when a player's game piece 28 lands upon a playing station the rules pertaining to that playing station come into play. For example, the plurality of playing stations include playing stations having indicia which indicates a specific business expense 40 which must be paid by the player. In the shown embodiment, there are six specific business expense playing stations 40 which include insurance premium due, remodel cost, advertising cost, mortgage payment due, payroll taxes due, and sales tax due. It may be appreciated that other specific business expenses could also be utilized.

The plurality of playing stations also includes playing stations having indicia which effects a randomly determined business expense 42. In the shown embodiment, there are four business expense playing stations 42 all of which are marked business expense. When a player lands upon a business expense playing station 42, the player draws a random card from a set (deck) of business expense cards 44, each business expense card 44 having indicia which indicates a business expense. FIG. 10 shows a business expense card 44. In the shown embodiment, there are 22 business expense cards 44. These are:

Insure Workers. As a new franchisee, purchase Workman's Compensation insurance at statutory limits. Pay $2,000.

Unethical Practice! The Franchiser/Banker has to terminate one of your sites. You have been found not following company standards. You must surrender a site to the bank and lose your down payment.

To Your Health! Health insurance premiums are due for all employees. Pay $1,000 for each site owned.

Insurance! Business insurance premium is due. Pay $2,500 per site.

Violation! You (franchisee) are in violation of standard operating procedures. Move back to the last location of the board. Pay franchise fee. Pay $500.

Growing Pains! Mortgage payment due. Make a mortgage payment plus ten percent interest on one site.

Computer Upgrade! Your new sales software program is installed. Pay licensing fees. Roll dice for amount times (X) $1,000.

In Arrears! Your are delinquent with franchise fees to Franchiser. Roll dice for amount times (X) $1,000.

Franchising/Licensing! Your attorney has just completed reviewing your franchise agreement for an additional site for its legality and your protection. Pay him $1,000 fee. (A Cost of Doing Business)

Political Error! As a corporation, you violated campaign laws by contributing to a political candidate. Pay a fine of $2,000.

A Share For The Tax Man! Personal income tax is due. Pay 10% of your cash on hand.

Form Corporation! Franchisee forms his new corporation as a Sub. Chapter S Corporation in order to limit liability. Pay lawyers $2,500.

Ante Up! Interest is due on borrowed capital. Pay $300 on each site owned.

Software Glitch! Your site's computers crash. Call help services and fix the problem. Pay $500 for services rendered.

Insurance—Surcharge! Your site has exceeded the annual workman's compensation quote. Pay $3,000.

New Business! Pay your accountant (bank) $1,500 for forming a new corporation for an additional site that you just purchased. (A cost of doing business)

Welcome To The 21st Century! Remodel your sites. Pay $500 per site.

Good Corporate Citizen! Your site is co-sponsoring a $25,000 educational scholarship for the most outstanding student at your local high school. Pay $2,500.

Pay the Ad Man! Franchiser is permitted to raise advertising costs on a period basis. Pay 10% of your cash on hand.

Bills, Bills, Bills . . . . Your monthly yellow page advertising is due. Pay $1,500.

Hitting Rock Bottom! Your business account is overdrawn. Make a deposit immediately to cover outstanding checks. Pay $1,500.

Location Scout As Franchisee you have expended time, effort and money to select a site. Send all drawings, specifications and forecast of site to Franchiser for final approval. Pay $1,500.

In an embodiment of the game, a plurality of violation cards are added to the set of business expense cards 44. When a player draws a violation card the player keeps the card. If the player accumulates three violation cards, the player is eliminated from the game. In the shown embodiment, there are 5 violation cards. These are:

VIOLATION The IRS finds you guilty of withholding income taxes due the government. (HOLD THIS CARD)

VIOLATION You ignored sexual harassment charges brought by an employee against her supervisor. (HOLD THIS CARD)

VIOLATION You failed to comply with OSHA orders within 60 days. (HOLD THIS CARD)

VIOLATION You conspired to procure a city contract unethically by contributing to a political fundraiser. (HOLD THIS CARD)

VIOLATION E-Coli or Salmonella is discovered in the food, and you attempted to bribe the inspector into not issuing a citation. (HOLD THIS CARD)

The plurality of playing stations also includes playing stations having indicia which effects a randomly determined business opportunity 46. In the shown embodiment, there are four business opportunity playing stations 46 all of which are marked business opportunity. When a player lands upon a business opportunity playing station 46, the player draws a random card from a set (deck) of business opportunity cards 48, each business opportunity card 48 having indicia which indicates a business opportunity. FIG. 11 shows a business opportunity card 48. In the shown embodiment, there are 22 business opportunity cards 48. These are:

Good Idea! Receive a bonus for high volume sales. Collect $5,000.

Special Invitation! Pick a free bonus card now. Good luck!

Community—Service Girl Scout Goodies! The Girl Scouts of America orders pizza, donuts and hamburgers for 300 scouts. Collect $2,000.

Sponsor Award! Franchiser and its five (5) partners in education scholarships names your site "The Model Franchisee of the Year". Congratulations and keep up the good work! Collect $5,000.

Government Award! Because of the certification of your employees, your company has been awarded a contract for the product/services that you provided. Collect $5,000.

Community—Involvement Business Lunch! The local chamber of commerce orders a weekly lunch for 25. Collect $1,000.

Community—Involvement Boy Scout Jamboree! The Boy Scouts of America orders pizza, donuts and hamburgers for a 100 Scout Jamboree. Collect $1,000.

Speaker Of The House! Your business skills have developed in building your franchise chain and has earned you to be Head Speaker at the National Business Seminar. Collect $2,000.

Corporate Benefit! Your choice in choosing the franchise business and building your national chain is greatly developed and has earned you semi-annual bonuses. Collect $5,000.

Refund! Franchiser selects your site as a training and sales conference center. Your receive rental payments. Collect $12,000.

Gimme Some Brotherly Love! Advance to Philadelphia, Pa. (If you pass Start, collect your salary). If owned, pay franchise fee. If unowned, you may purchase it from Franchiser/Banker.

Free Pass! The card protects you from any penalties until you collect your next salary. Return card to deck after you pass Start and collect your salary.

Franchise Fees Refund! Franchiser credits your site for franchise fee overpayments. Collect $5,500.

Short On Capital! The bank has agreed to factor your outstanding monthly receivables for 60 days for a rate of 50% of the total owed your company. Collect $10,000 (Loan).

Leaving No Child Behind Act! Your company has earned a reputation in working for this cause. You are happy to contribute $1,000 for scholarship funding.

Condemned! The local township passes a condemnation ordinance that condemns a part of your franchise site's property and pays reasonable compensation. Collect $6,500.

Interesting! Your business account earns annual interest. Collect $4,000.

Refund! Your site is sold. Since you are moving, you receive a refund. Collect $12,000.

Repair Reimbursement! Franchiser credits your site for repairs of equipment that is covered under warranty. Collect $13,000.

Fun in the Sun! Advance to Tampa, Fla. (If you pass Start collect your salary). If owned, pay Franchise Fee. If unowned, you may purchase it from Franchiser/Banker.

Damaged Goods! Franchiser receives your returned damaged goods (food, merchandise and supplies). Collect $6,000.

Congratulations! You are crowned the "Entrepreneur of the Year" for winning the Mind Your Own Business finals at a local amusement park, and are awarded the use of a sponsor site for one year, with a scholarship for which you collect $15,000 from the bank.

The plurality of playing stations also includes playing stations having indicia which represents a franchise headquarters 50 for one of the business entities. In the shown embodiment, there are four franchise headquarters playing stations 50 (marked headquarters special opportunity), one for each of the four business entities. These four playing stations have indicia which represents one particular business entity. In an embodiment of the invention, the indicia which represents the business entity is the logo 52 or other identifying mark of the business entity (shown herein as #1, #2, #3, and #4). Other playing stations can also have the logo 52 of the business entity.

The plurality of playing stations also includes a start playing station 53. Each time a player's game piece 28 passes start playing station 53, the player receives a weekly salary of $2,000. Also however, each time the player's game piece 28 passes start playing station 53, the player must pay a $100 franchise fee for each franchise site playing station 36 on which the player has established a franchise (owns the franchise site 36).

The plurality of playing stations also includes playing stations having indicia which indicates a bank dividend 54. In the shown embodiment, there are four bank dividend playing stations 54.

The plurality of playing stations also includes playing stations having indicia which effects a randomly determined business bonus 56. In the shown embodiment, there are three business bonus playing stations 56 all of which are marked take a bonus card. When a player lands upon a business bonus playing station 56, the player draws a random card from a set (deck) of business bonus cards 58, each business bonus card 58 having indicia which indicates a business bonus. FIG. 12 shows a business bonus card 58. In the shown embodiment, there are 14 business bonus cards 58. These are:

Website Pays Off! You receive your first large order from your new award winning interactive website. Collect $12,500.

Congratulations! Headquarters awards you "The Model Franchisee of the Year".

Congratulations and keep up the good work! Collect $10,000.

Excellence Award! Franchiser awards you $10,000 for the outstanding image, cleanliness and service at your site. Congratulations and keep up the good work! Collect $10,000.

Buyer's Remorse! You have decided not to purchase a franchise site because your financing fell through. Franchiser refunds your deposit of $5,000. Collect $5,000.

Show Me The Money. You are selected as area operations expert and trainer. Your receive an extra bonus and expenses. Roll dice for amount times (X) $1,000.

Environmental Relief. The federal government has recognized your campaign efforts in helping resolve the environmental problem in your area and awards you relief. Collect $5,000.

Uncle Sam Helps Out! The Small Business Administration gives you a loan for the down payment on another franchise site. Roll dice 3 times: If 1 snake eye—collect $25,000, if 2 shake eyes—collect $50,000, if 3 snake eyes—collect $100,000.

Partnership Pays! Since your franchise site is so profitable, you have taken on a limited partner to continue developing your business, particularly purchasing another site. Collect $10,000.

How Smart! Sponsors award your franchise site a scholarship grant for training students. Collect $5,000.

Madison Avenue Pays Off! National advertising accounts joins you in a special public relations campaign. Roll dice and collect amount time (X) $1,000.

Franchiser Award. Award received for donating one of your sites for a political campaign to elect the next governor. The company awards you some help. Collect $5,000.

$1,000 Challenge Opportunity. You have just earned an additional $1,000 challenge opportunity. Select an opponent and pay $1,000 if you choose to now.

Acquisition. Here's your chance to buy out an opponent's site. Select an opponent and then roll dice 3 times. 2 snake eyes wins opponent's site. Pay opponent the entire cash outlay on site and assume balance of mortgage owed to bank. (note there are two of this bonus card in set of bonus cards 58)

The plurality of playing stations includes playing stations having indicia which randomly allows a player to acquire a franchise site 36 of a single other player 60. In the shown embodiment there are four such playing stations, each marked with 7-11 challenge. As will be discussed later, randomizer 30 is utilized to allow a player to challenge another player for ownership of a franchise site 36.

An ultimate franchise challenge playing station 62 is disposed upon playing area 22. Ultimate franchise challenge playing station 62 is not part of path 26, but rather a stand alone playing station. As will be discussed later, ultimate franchise challenge playing station 62 has indicia which randomly allows a player to acquire franchise sites 36 from all other players.

FIG. 10 is a top plan view of a business expense card 44 which states the business expense which the player must pay.

FIG. 11 is a top plan view of a business opportunities card 48 which states the business opportunity presented to the player.

FIG. 12 is a top plan view of a bonus card 58 which states a playing bonus.

FIGS. 13 and 14 are top plan and bottom plan views respectively of an area director card 64. In an embodiment of the game, a player may become an area director by rolling three ones (triple snake eyes) on his/her turn.

Figures 15, 16, 17, 18, 19, 20:
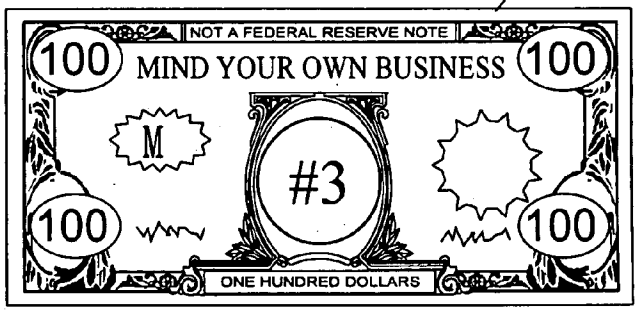
FIG. 15 is a top plan view of an option to buy card.
FIG. 16 is a bottom plan view of the option to buy card.
FIG. 17 is a top plan view of game money.
FIG. 18 is a top plan view of a franchise site card.
FIG. 19 is a bottom plan view of the franchise site card.
FIG. 20 is a top plan view of a challenge certificate.

FIGS. 15 and 16 are top plan and bottom plan views respectively of an option to buy card 66. The game contains 10 option to buy cards. If a player lands on an un-owned franchise site playing station 36, and does not have enough money to make a down payment, the player can purchase an option to buy card 66 from the bank for a fee of $1,000. Subsequently, if another player lands on the franchise site playing station 36 and wants to purchase it, the player holding the option to buy card 66 must immediately make a down payment on the franchise site 36 or surrender the option to buy card 66. The $1,000 fee is not refundable.

FIG. 17 is a top plan view of game money 68, a $100 note being shown. The game includes $100, $500, $1,000, and $5,000 monetary denominations. At the beginning of the game, each player receives $25,000 in game money 68.

FIGS. 18 and 19 are top plan and bottom plan views respectively of a franchise site card 70. The game contains 4 sets (one for each player) of 10 franchise site cards 70 (one for each of the ten franchise site playing stations 36). When a player establishes a franchise upon a franchise site playing station 36, the player receives a franchise site card 70 for that franchise site.

FIG. 20 is a top plan view of a challenge certificate 72. The game contains eight challenge certificates. At the beginning of the game, two challenge certificates 72 are given to each player. These certificates 72 are utilized to make a grand challenge as is described below.

FIG. 21 is a top plan view of a mortgage payment sheet 74. The mortgage payment sheet 74 contains information on the value, down payment, and mortgage payments of each franchise site playing station 36. A game banker utilizes mortgage payment sheet 74 to keep track of mortgage payments made by the players on each of the franchise site playing stations 36.

In terms of use, a method for a plurality of players to play a game, includes:

(a) providing a game including:

a game piece 28 for each of the plurality of players;

a playing area 20;

a plurality of playing stations is disposed upon playing area 20, the plurality of playing stations forming a path 26 along which the plurality of game pieces 28 may move, and each playing station of the plurality of playing stations having rules which are imposed when a player's game piece 28 lands upon that playing station;

a randomizer 30 for (1) determining the extent of movement of game pieces 28 along path 26, and (2) other game activities;

the plurality of playing stations including a plurality of franchise site playing stations 36, wherein each franchise site playing station 36 has indicia which represents a unique franchise site; and, a plurality of unique business entities;

a plurality of business entity markers 38 which represent the business entities;

wherein an object of the game is for a player to establish a franchise for one of the business entities at each franchise site playing station 36, and in so doing place a business entity marker 38 for that business entity upon each franchise site playing station 36. It is noted that once a franchise is established by one player on a particular franchise site playing station 36, other players are prevented from establishing a franchise on that same franchise site playing station 36 unless rules of the game to be discussed later specifically so permit.

(b) the plurality of players taking turns moving their game pieces 28 along path 26, game pieces 28 landing upon a playing station and following the rules imposed by that playing station; and, (c) in step (b), when a player's game piece 28 lands upon a franchise site playing station 36 the player establishing a franchise at the franchise site playing station 36.

The method further including:

in step (a), each player of the plurality of players being associated with one business entity;

in step (b), each player having a plurality of business entity markers 38 for his/her associated business entity; and, in step (c), the player placing a business entity marker 38 upon a franchise site playing station 36 indicating that a franchise for his/her associated business entity has been established thereon.

The method further including:

in step (a), said plurality of playing stations including playing stations having indicia which indicates a specific business expense 40; and, in step (b), when a player's said game piece lands upon a said playing station having indicia which indicates a specific business expense 40, the player paying said indicated specific business expense. In an embodiment of the game, the player pays the indicated specific business expense 40 for each franchise site playing station 36 for which he/she has established a franchise.

The method further including:

in step (a), the plurality of playing stations including playing stations having indicia which effects a randomly determined business expense 42;

in step (a), providing a set of business expense cards 44, each business expense card 44 having indicia which indicates a business expense; and, in step (b), when a player's game piece 28 lands upon one of the playing stations having indicia which effects a randomly determined business expense 42, the player drawing a card from the set of business expense cards 44 and paying the business expense contained thereon.

The method further including:

in step (a), the plurality of playing stations including playing stations having indicia which effects a randomly determined business opportunity 46;

in step (a), providing a set of business opportunity cards 48, each business opportunity card 48 having indicia which indicates a business opportunity; and, in step (b), when a player's game piece 28 lands upon one of the playing stations having indicia which effects a randomly determined business opportunity 46, the player drawing a card from the set of business opportunity cards 48 and following the instructions contained thereon.

The method further including:

in step (a), each player of the plurality of players being associated with one business entity;

in step (a), the plurality of playing stations including playing stations having indicia which represents a franchise headquarters for one of the business entities 50; and, in step (b), when a player's game piece 28 lands upon the franchise headquarters playing station 50 for his/her said business entity, the player being afforded the opportunity to establish, at half price, a franchise on any franchise site playing station 36 which is not owned by another player. For example if a player has chosen to be associated with business entity #2, and during play the player's game piece 28 lands upon the franchise headquarters playing station 50 for business entity #2, the player is afforded the opportunity to establish, at half price, a franchise on any franchise site playing station 36 which does not already have the franchise of another player.

The method further including:

in step (a), the plurality of playing stations including playing stations having indicia which indicates a bank dividend 54; and, in step (b), when a player's game piece 28 lands upon a playing station having indicia which indicates a bank dividend 54, the player being paid the indicated bank dividend.

The method further including:

in step (a), the plurality of playing stations including playing stations having indicia which effects a randomly determined business bonus 56;

in step (a), providing a set of business bonus cards 58, each business bonus card having indicia which indicates a special business bonus; and, in step (b), when a player's game piece 28 lands upon one of the playing stations having indicia which effects a randomly determined business bonus 56, the player drawing a card from the set of business bonus cards and 58 following the instructions contained thereon.

The method further including:

in step (a), the plurality of playing stations including playing stations having indicia which randomly allows a player to acquire a franchise site playing station 36 of a single other player 60; and, in step (b), when a player's game piece 28 lands upon one of the playing stations having indicia which randomly allows a player to acquire a franchise site playing station 36 of a single other player 60 (7-11 challenge), the player and the single other player utilize randomizer 30 to determine if (1) the player acquires the franchise site playing station 36 of the single other player, or (2) if the single other player retains the franchise site playing station 36. In an embodiment of the game, the player is given the opportunity to roll dice 30 (randomizer) two times. If on either roll the player rolls a total of 7 or 11, the other player is given the opportunity to roll the dice 30 two times. If the other player is successful in rolling 7 or 11, the other player retains the franchise site playing station 36. If the other player does not roll a 7 or 11, the player takes over the franchise site playing station 36, including any mortgage balance. It is noted that if the player is not successful in rolling a 7 or 11, his/her turn ends.

The method further including:

in step (a), providing an ultimate franchise challenge playing station 62 disposed upon the playing area 20, the ultimate franchise challenge playing station 62 not being part of path 26. The ultimate franchise challenge playing station 62 has indicia which randomly allows a player to acquire franchise site playing stations 36 from all other players;

in step (b), the player paying a sum of money; and, in step (b), the player utilizing randomizer 30 to generate a number, and if the generated number is equal to a predetermined number, the player being given the opportunity to acquire franchise site playing stations from all other players. In an embodiment of the invention, the predetermined number which must be obtained is three ones (triple snake eyes). If the player throws three ones the player may purchase as many franchise site playing stations 36 from other players as he/she can afford. If the player does not throw three ones, the player's game piece 28 is returned to the start playing station 53 and a $2,000 weekly salary is not collected.

The method further including:

in step (b), a player may pay an other player a predetermined sum of money and then utilize randomizer 30 to generate a number. If the generated number is equal to a predetermined number, the player pays the other player one-half of the value of a franchise site playing station 36 upon which the other player has established a franchise, and the player receives the franchise site playing station 36 from the other player. In an embodiment of the game, the player pays the other player $1000 for an opportunity to roll dice 30 three times. If on any of the three rolls doubles are obtained (on the two conventional dice 32), the player pays the other player half of the investment in the franchise site playing station 36 and takes over the franchise site playing station 36 and assumes any mortgage thereon.

The method further including:

in step (a), providing each player with a challenge certificate 72;

in step (b), the player surrendering challenge certificate 72;

in step (b), the player utilizing randomizer 30 to generate a number, and if the generated number is equal to a predetermined number, the player receiving a predetermined sum of money. In an embodiment of the game, each player receives two challenge certificates 72 which may be used to make a grand challenge. In the grand challenge, the player is given one opportunity to roll dice 30. If the player rolls three ones (triple snake eyes) the player receives $100,000.

The method further including:

in step (b), when a player's game piece 28 lands upon a franchise site 36 owned by another player, the player pays the other player a product/service fee. The amount of the product/service fee is shown on the franchise site card 70 for the franchise site playing station 36. In an embodiment of the game, the product/service fee is 10% of the down payment of the franchise site 36.

The method further including:

in step (a), randomizer 30 includes two conventional dice 32 plus a third die 34 having a representation of a number one on one side and five blank sides.

The method further including;

in step (b), third die 34 not counting in the determination of the extent of movement of game pieces 28 along path 26.

The method further including:

in step (b), if randomizer 30 generates a predetermined number, the player choosing between (1) receiving a predetermined sum of money, (2) establishing a franchise upon a franchise site playing station 36 which is not taken by another player, (3) becoming an area director, and (4) acquiring one franchise site playing station 36 from each other player. In an embodiment of the game, the predetermined number is rolling three ones (triple snake eyes), and the sum of money is $25,000.

The method further including:

in step (b), if a player is an area director, the player receives a predetermined sum of money each time another player's game piece 28 passes one of the playing stations on path 26. In an embodiment of the game, the predetermined sum of money is $300 for each franchise site playing station 36 owned by the other player, and the playing station is the start playing station 53.

The method further including:

in step (b), if a player lands upon a franchise site playing station 36, the player may pay a predetermined sum of money to obtain a option to buy the franchise site playing station 36.

The method further including:

a player being eliminated from the game if at any time all franchise site playing stations 36 have an established franchise of another player.

The method further including:

a player being eliminated from the game if during play of said game the player's assets fall below a predetermined value. In an embodiment of the game, the predetermined value is $5,000.

The method further including:

before step (b), each player being given a franchise at one franchise site playing station 36.

The method further including:

during step (b), each time a player's game piece 28 passes a predetermined playing station, the player paying a franchise fee for each franchise owned by the player. In an embodiment of the game, the predetermined playing station is start 53, and the franchise fee is $100 for each franchise site playing station 36 owned by the player.

The method further including:

during step (b), when a player has established franchises on a predetermined percentage of the franchise site playing stations 36, the player can optionally buy the franchises of other players. In an embodiment of the game, the predetermined percentage is 70%.

The method further including:

in step (a), the plurality of playing stations including playing stations having indicia which effects a randomly determined business expense;

in step (a), providing a set of business expense cards;

in step (a) a plurality of violation cards being added to the set of business expense cards;

in step (b), when a player's game piece lands upon one of the playing stations having indicia which effects a randomly determined business expense, the player drawing a card from the set of business expense cards and violation cards;

if the drawn card is a violation card, the player keeping the violation card; and, if the player accumulates three violation cards, the player being eliminated from the game.

Rules of the Game

The following game equipment is included:

| | |
|---|---|
| 1 | game board |
| 3 | dice |
| 4 | game pieces |
| 22 | business opportunity cards |
| 22 | business expense cards |
| 14 | bonus cards |
| 1 | area director card |
| 10 | option to buy cards |
| 4 | sets of 10 business entity markers |
| 4 | sets of 10 franchise site cards |
| 1 | mortgage payment sheet & marker |
| 8 | challenge certificates |
| 1 | pad of sticky mortgage sheets (50) |
| 1 | set of game money (totaling $570,200) |

The object of the game is to place franchises upon all ten franchise site playing stations 36, thereby creating a franchise chain.

Two to four players select a banker who gives each player $25,000 in game money 68 consisting of (3) $5,000, (7) $1,000, (5) $500, (5) $100, and (2) two challenge certificates 72. The banker is also referred to as the franchiser/banker.

The banker puts the game board 22 on the table and places the business expense cards 44, business opportunity cards 48, and bonus cards 58 face down in their respective positions on the board 22. Finally, each player selects the franchise chain (business entity) the player wants to develop.

The banker then gives each player a franchise site card 70 (Chicago, Denver, Nashville, or Philadelphia), and marks the down payment as paid on mortgage payment sheet 74. The banker also records all future down payments and mortgage payments on mortgage payment sheet 74.

The banker then distributes business entity markers 38 (franchise signs) to each player, based on the franchise sponsor the player has chosen. As the game progresses, the banker also collects all penalty money owed and disburses salary and success income and distributes area director 64 and option-to-buy cards 66.

Starting the Game

Roll the dice. There are three dice 30, two conventional dice 32, and one die 34 which has one red dot that counts only (1) if three ones (triple snake eyes are rolled) during a player's normal turn, (2) rolling for the grand challenge, and (3) rolling for the ultimate challenge.

When during a player's turn the player rolls three ones (triple snake eyes) the player may either:

Accept $25,000 from the bank choose a franchise site 36 from the bank with the mortgage paid in full accept an area directorship, or acquire one franchise site 36 from each player by paying them half of their cash investment and assume the balance of the mortgage on the franchise site 36

If a player rolls doubles, the player completes his/her turn and rolls again. It is noted that doubles only apply to the two conventional dice 32. Should the player role doubles three times in a row, the player receive $10,000 from the bank.

A Player's Turn

Before rolling the dice 30 the player takes care of any desired business, such as making mortgage payment, purchasing an optioned site, selling assets, and/or initiating the $1,000 challenge, the grand challenge for hostile takeovers (explained later), and the ultimate challenge. A player can make only two challenges on each trip around the board (not including the 7-11 challenge).

When a player rolls the dice 30 to move around the game board 22, the player moves his/her game piece 28 clockwise around the game board 22 a number of playing stations equal to the total number appearing on the two conventional dice 32, and follows the instructions for the playing station upon which the game piece 28 lands. Each time a player's game piece 28 circles game board 22 by passing start 53, the player collects a salary of $2,000 and pays a franchise fee of $100 per franchise her/she owns.

When a player's game piece 28 lands on an un-owned franchise site 36, the player may buy that site from the bank or purchase an option-to-buy card 66 from the bank for $1,000. The purchase may be made by making a down payment which is cited on the franchise site card 70 for the particular franchise site playing station 36. The player pays the bank the down payment noted on the franchise site card 70, which the banker notes on the mortgage payment sheet 74. Upon each purchase or successful hostile takeover, the player erects his/her business entity sign 38 on the franchise site 36.

NOTE: Franchise sites 36 cannot be sold or re-mortgaged to other players. Once all franchise sites 36 have been purchased from the bank, and a player does not own at least one franchise site 36, either through failure to purchase, or if sites are seized by opponent challenges, the player is eliminated from the game and all of the player's assets revert to the bank.

Product/Service Fee

If a player's game piece 28 lands on a franchise site 36 owned by another player, the player must pay a product/service fee to the owner of the site. The product/service fee is based on the amount of payments paid into the site, as has been recorded on the mortgage payment sheet 74. The amount of the product/service fee is shown on the franchise site card 70. In an embodiment of the game, the product/service fee is 10% of the down payment of the franchise site 36.

Option-to-Buy Cards

If a player's game piece 28 lands on an un-owned franchise site 36, and the player does not have enough capital to make the down payment, the player may purchase an option-to-buy card 66 from the bank for $1,000. Subsequently, if another player lands on that franchise site 36 and wants to purchase it, the player holding the option-to-buy must immediately make a down payment or surrender the option-to-buy card 66. The $1,000 is not refundable.

Challenges

Challenges are a key to success in the game. Players are permitted their choice of any challenge at the beginning of their turn. However, players are only allowed two challenges each time the player's game piece 28 circles the board 22. The 7-11 challenge is exempt from the two challenge limit.

7-11 Challenge

If a player's game piece 28 lands on a 7-11 challenge playing station 60, the player may challenge any opponent. The challenging player rolls the dice 30 twice, seeking a 7 or 11. If the player is successful, the other player (franchise site 36 owner) gets two rolls, and if the other player rolls a 7 or 11, acquisition is denied. If the other player does not roll a 7 or 11, the challenging player takes over the franchise site 36 by paying the other player the full cash investment in the franchise site 36, and assuming the balance of the site mortgage.

$1,000 Challenge

A player may offer a $1,000 challenge to any opponent at the start of the player's turn. The player pays $1,000 to the opponent for the opportunity to take over a franchise site 36. The player has three opportunities to roll the dice 30. If on one of the times the player rolls doubles, the player assumes the site and site mortgage by paying the opponent half of the cash investment in the site.

Grand Challenge

At the start of a player's turn, the player (surrenders) a challenge certificate 72 to the banker for the chance to roll the dice 30 three times for three ones (triple snake eyes). If successful, the bank awards the player $100,000.

Ultimate Franchise Challenge

When it is a player's turn, the player moves his/her game piece 28 into the ultimate franchise challenge playing station (circle) 62 and pay the bank $1,000 to qualify to roll the dice 30 three times three ones (triple snake eyes). If successful, the player may purchase as many franchise sites 36 as he/she can afford by paying each other player their cash investment in the franchise site 36. If the player does not roll three ones, the player's game piece 28 goes back to start 53 and the player does not collect $2,000.

Solvency & Elimination

Each player must always have $5,000 in assets or the player is eliminated from the game. Once all franchise sites 36 have been purchased, any player who does not own any franchise sites 36 is eliminated from the game and their remaining assets revert to the bank Salary Each time a player game piece 28 passes the salary playing station 53, either by rolling the dice or drawing a card, the player collects a $2,000 salary from the bank. However, also each time the player's game piece 28 passes salary 53, the player must pay a franchise fee of $100 to the bank for each owned franchise site 36.

Bank Dividend

If a player's game piece 28 lands on a bank dividend playing station 54, the player has two opportunities to roll the dice 30 for doubles. If successful, the player receives $5,000 from the bank.

Franchise Headquarters

If a player's game piece 28 lands on his/her business entities franchise headquarters playing station 50, the player may purchase an un-owned franchise site 36 at half price. Payments made in subsequent turns on the purchased franchise site 36 are at full price. The player must act before ending that turn and the player does not have the right to purchase an option to buy card 66.

Business Expense Cards, Business Opportunity Cards, and Bonus cards

When a player's game piece 28 land upon one of these playing stations, the player draws a card from the appropriate set of cards and follows the instructions on the drawn card.

Re-Mortgage

A player may re-mortgage one or more of the player's franchise sites 36 with the bank for up to one half of the player's total investment in the franchise site 36. The banker places the franchise site 36 in a holding area with a sticky mortgage paper until the mortgage is satisfied along with a 10% interest payment. Re-mortgaged franchise sites 36 are susceptible to the $1,000 challenge.

Sale of Assets

Option-to-buy cards 66 and area director cards 64 may be sold to another player at a mutually negotiated price.

Area Directorship

An area director supervises, administers and renders consulting services to all sites. A player may become an area director by rolling three ones (triple snake eyes) during his/her turn. Each time a player passes salary 53, the player pays the area director $300 for each franchise site 36 the player owns. After becoming an area director, the area director receives a commission of $2,000 from the bank each time any franchise site playing station 36 is sold. The player can also sell his/her area directorship to another player at a negotiated price.

Short Game

Players may set a time limit for the game at their own discretion. When the time limit expires, the player who owns the most franchise sites 36 wins the game.

Franchisee Control Buyout

When a player owns at least 70% of the franchise sites 36, and the player has sufficient money, the player can force the other players to sell their franchise sites 36 for the entire investment in the franchise site 36. Such a buyout may be for one or more of the franchise sites 36 owned by other players, and must occur during a player's turn. If the buyout includes all franchise sites 36 owned by others, the player exercising the control buyout automatically win the game. Mortgages do not have to be satisfied for the buyout.

Violations

In an embodiment of the game, a plurality of violation cards are added to the set of business expense cards 44 (five violation cards in the shown embodiment). When a player draws a violation card the player keeps the card. If the player accumulates three violation cards, the player is eliminated from the game.

The preferred embodiments of the invention described herein are exemplary and numerous modifications, variations, and rearrangements can be readily envisioned to achieve an equivalent result, all of which are intended to be embraced within the scope of the appended claims. Such modifications, variations, and rearrangements can include, but are not limited to, the number of playing stations, the physical arrangement of the playing stations, the number of franchise sites or other game playing stations, the names of the franchise site cities, the number of players, the monetary value of prices, fees, and bonuses, the nature of business expenses, business opportunities, and bonuses, the number and name of sponsors, the nature of the randomizer, and the like.

I claim:

1. A method for a plurality of players to play a game, comprising:

(a) providing a game including:

a game piece for each of the plurality of players;

a playing area;

a plurality of playing stations disposed upon said playing area, said plurality of playing stations forming a path along which said game pieces may move, and each playing station of said plurality of playing stations having rules which are imposed when a player's said game piece lands upon that said playing station;

a randomizer for determining the extent of movement of said game pieces along said path;

said plurality of playing stations including a plurality of franchise site playing stations, wherein each said franchise site playing station has indicia which represents a unique franchise site;

a plurality of unique business entities;

a plurality of business entity markers which represent said business entities;

(b) each player choosing one of said plurality of business entities;

(c) said business entity markers being distributed to each player based on said chosen business entity of step (b), wherein each said player receives a number of said business entity markers sufficient to place one said business entity marker on each said franchise site playing station;

(d) after steps (b) and (c), using said randomizer the plurality of players taking turns moving their said game pieces along said path, said game pieces landing upon a said playing station and following said rules imposed by that said playing station;

(i) wherein the object of said game is for a player to establish a franchise for his/her said business entity at each said franchise site playing station, and in so doing place a said business entity marker for his/her said business entity on each said franchise site playing station; and, (ii) when a player's said game piece lands upon an unowned said franchise site playing station the player establishing a franchise at said franchise site playing station and placing a said business entity marker on said franchise site playing station; and, (e) continuing with step (d) until (1) a first player has his/her franchises on all franchise site playing stations and wins the game, or (2) the players setting a time limit, and the player who has established the most franchises at the end of the time limit wins the game.

2. The method of claim 1, further including:

in step (a), said plurality of playing stations including playing stations having indicia which effects a randomly determined business expense;

in step (a), providing a set of business expense cards, each said business expense card having indicia which indicates a business expense; and, in step (d), when a player's said game piece lands upon one of said playing stations having indicia which effects a randomly determined business expense, the player drawing a card from said set of business expense cards and paying said business expense contained thereon.

3. The method of claim 1, further including:

in step (a), said plurality of playing stations including playing stations having indicia which effects a randomly determined business opportunity;

in step (a), providing a set of business opportunity cards, each said business opportunity card having indicia which indicates a business opportunity; and, in step (d), when a player's said game piece lands upon one of said playing stations having indicia which effects a randomly determined business opportunity, the player drawing a card from said set of business opportunity cards and following the instructions contained thereon.

4. The method of claim 1, further including:

in step (a), said plurality of playing stations including a franchise headquarters playing station for each of said business entities; and, in step (d), when a player's said game piece lands upon said franchise headquarters playing station for his/her said business entity, the player being afforded the opportunity to establish a franchise on any franchise site playing station which is not owned by another player.

5. The method of claim 1, further including:

in step (a), said plurality of playing stations including playing stations having indicia which indicates a bank dividend; and, in step (d), when a player's said game piece lands upon a said playing station having indicia which indicates a bank dividend, the player being paid said indicated bank dividend.

6. The method of claim 1, further including:

in step (a), said plurality of playing stations including playing stations having indicia which effects a randomly determined business bonus;

in step (a), providing a set of business bonus cards, each said business bonus card having indicia which indicates a special business bonus; and, in step (d), when a player's said game piece lands upon one of said playing stations having indicia which effects a randomly determined business bonus, the player drawing a card from said set of business bonus cards and following the instructions contained thereon.

7. The method of claim 1, further including:

in step (a), said plurality of playing stations including playing stations having indicia which randomly allows a player to acquire a said franchise site playing station of a single other player; and, in step (d), when a player's said game piece lands upon one of said playing stations having indicia which randomly allows a player to acquire a said franchise site playing station of a single other player, the player and the single other player utilizing said randomizer to determine if (1) the player acquires said franchise site playing station of the single other player, or (2) if the single other player retains said franchise site playing station.

8. The method of claim 1, further including:

in step (a), providing an ultimate franchise challenge playing station disposed upon said playing area, said ultimate franchise challenge playing station not part of said path, said ultimate franchise challenge playing station having indicia which randomly allows a player to acquire said franchise site playing station from all other players;

the player paying a sum of money; and, the player utilizing said randomizer to generate a number, and if said generated number is equal to a predetermined number, the player being given the opportunity to acquire said franchise site playing stations from all other players.

9. The method of claim 1, further including:

a player paying an other player a predetermined sum of money and then utilizing said randomizer to generate a number, and if said generated number is equal to a predetermined number, the player paying the other player one-half of the value of a said franchise site playing station upon which the other player has established a said franchise, and the player receiving said franchise site playing station from the other player.

10. The method of claim 1, further including:

in step (a), providing each player with a challenge certificate;

the player surrendering said challenge certificate;

the player utilizing said randomizer to generate a number, and if said generated number is equal to a predetermined number, the player receiving a predetermined sum of money.

11. The method of claim 1, further including:

in step (a), said randomizer including two conventional dice plus a third die having a representation of a number one on one side and five blank sides.

12. The method of claim 11, further including;

in step (d), said third die not counting in the determination of the extent of movement of said game pieces along said path.

13. The method of claim 11, further including:

in step (d), if said randomizer generates three ones, the player choosing between (1) receiving a predetermined sum of money, (2) establishing a franchise upon a said franchise site playing station which is not owned by another player, (3) becoming an area director, and (4) acquiring one said franchise site playing station from each other player.

14. The method of claim 13, further including:

in step (d), if a player is a said area director, the player receives a predetermined sum of money from another player each time the other player's said game piece passes one of said playing stations on said path.

15. The method of claim 1, further including:

in step (d), if a player lands upon a said franchise site playing station, the player paying a predetermined sum of money to obtain a option to buy said franchise site playing station.

16. The method of claim 1, further including:

a player being eliminated from said game if at any time all said franchise site playing stations have an established franchise of another player.

17. The method of claim 1, further including:

a player being eliminated from said game if during play of said game the player's assets fall below a predetermined value.

18. The method of claim 1, further including:

before step (d), each player being given a said franchise at one said franchise site playing station.

19. The method of claim 1, further including:

during step (d), each time a player's game piece passes a predetermined playing station, the player paying a franchise fee for each franchise owned by the player.

20. The method of claim 1, further including:

during step (d), when a player has established franchises on a predetermined percentage of said franchise site playing stations, the player can optionally buy said franchise site playing station of other players.

21. The method of claim 1, further including:

in step (a), said plurality of playing stations including playing stations having indicia which effects a randomly determined business expense;

in step (a), providing a set of business expense cards;

in step (a) a plurality of violation cards being added to said set of business expense cards;

in step (d), when a player's said game piece lands upon one of said playing stations having indicia which effects a randomly determined business expense, the player drawing a card from said set of business expense cards and said violation cards;

if said drawn card is a said violation card, the player keeping said violation card; and, if the player accumulates three said violation cards, the player being eliminated from said game.

* * * * *